US005112293A

United States Patent [19]

Vaccaro

[11] Patent Number: 5,112,293

[45] Date of Patent: May 12, 1992

[54] DOOR ASSEMBLY

[75] Inventor: Robert K. Vaccaro, Philadelphia, Pa.

[73] Assignee: Air-Shields, Inc., Hatboro, Pa.

[21] Appl. No.: 663,292

[22] Filed: Feb. 28, 1991

Related U.S. Application Data

[63] Continuation of Ser. No. 269,250, Nov. 9, 1988, abandoned.

[51] Int. Cl.[5] ..... A61G 11/00

[52] U.S. Cl. ..... 600/22; 128/205.26; 70/463; 292/DIG. 56; 292/DIG. 73

[58] Field of Search ..... 600/21, 22; 128/205.26; 292/DIG. 56, DIG. 73, 341.12, 210, 228, DIG. 17; 70/463; 312/215; 49/307; 220/326

[56] References Cited

U.S. PATENT DOCUMENTS

| | | | |
|---|---|---|---|
| 2,151,154 | 3/1939 | Roethel | 70/463 |
| 2,899,227 | 8/1959 | Gschwend | 70/463 |
| 3,335,713 | 8/1967 | Grosholz et al. | 600/22 |
| 4,773,392 | 9/1988 | Koch | 600/22 |
| 4,788,965 | 12/1988 | Milani et al. | 600/22 |

FOREIGN PATENT DOCUMENTS

| | | | |
|---|---|---|---|
| 1256354 | 12/1967 | Fed. Rep. of Germany | 600/22 |
| 6365 | 5/1886 | United Kingdom | 292/DIG. 56 |

*Primary Examiner*—Randall L. Green
*Assistant Examiner*—K. M. Reichle
*Attorney, Agent, or Firm*—Ratner & Prestia

[57] ABSTRACT

A door assembly in which an elastomeric roller, carried by a door, rolls against a latch member to pivot the latch member in one direction until the roller reaches a detent and then pivots in an opposite direction to lock the roller in the detent and the door in a closed position. The door is opened by pivoting the latch member in the first direction to release the roller from the detent.

14 Claims, 2 Drawing Sheets

FIG. 1
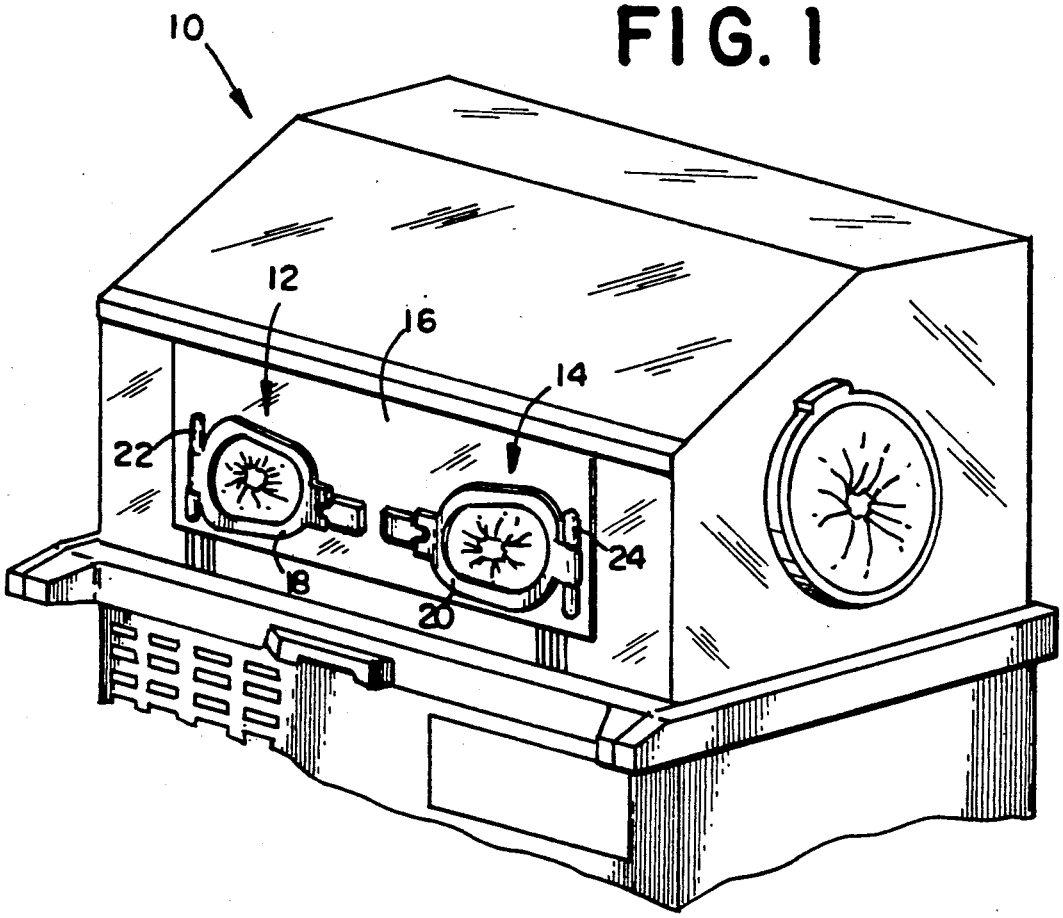
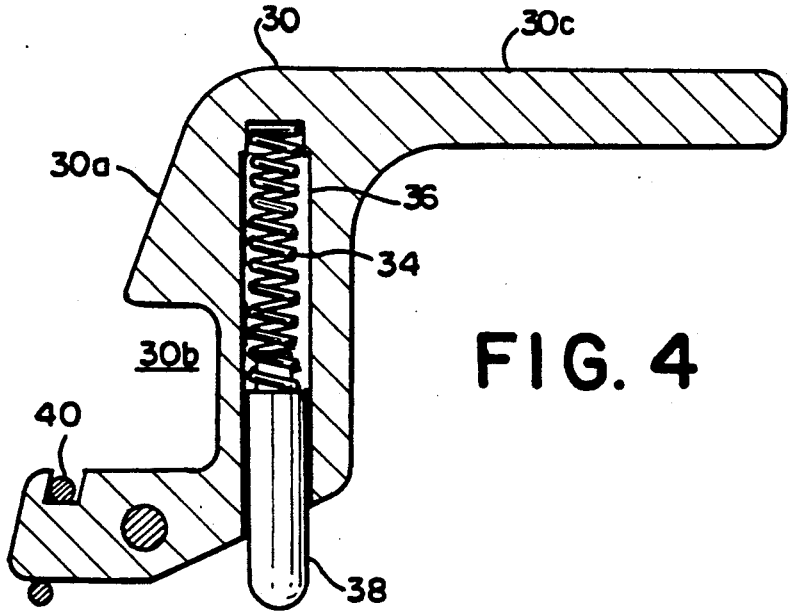
FIG. 4

FIG. 3A
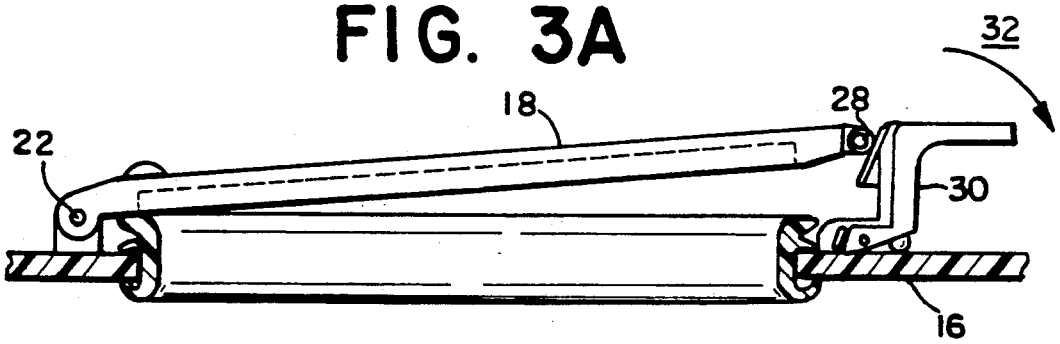
FIG. 3B
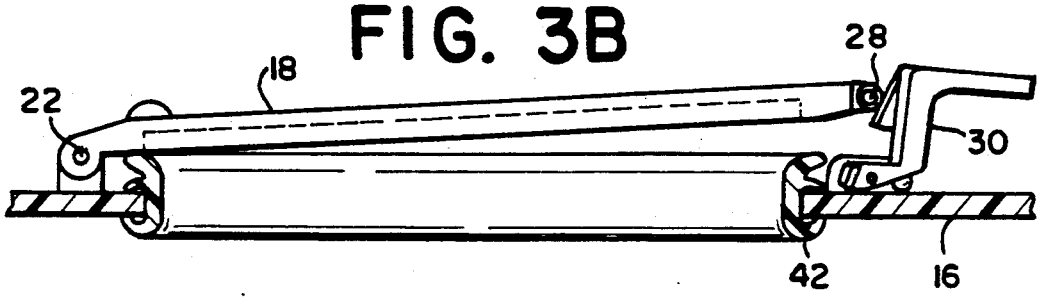
FIG. 3C
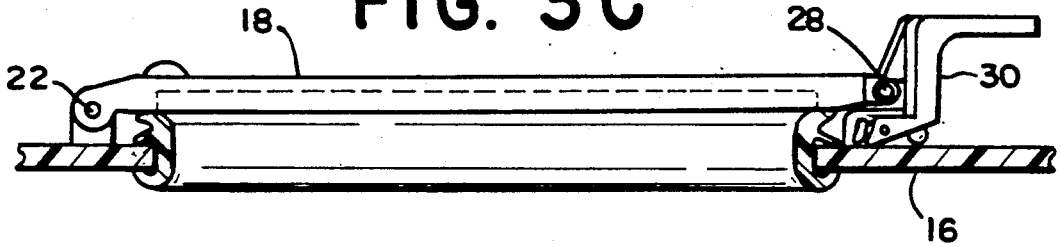
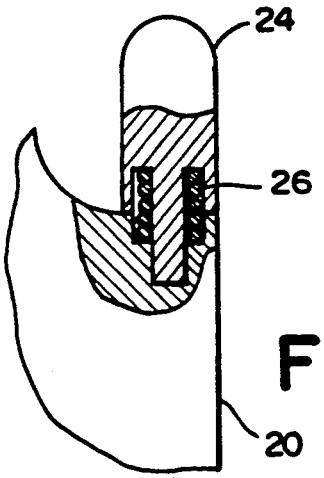
FIG.2

DOOR ASSEMBLY

This application is a continuation of application Ser. No. 07/269,250 filed Nov. 9, 1988 now abandoned.

TECHNICAL FIELD

The present invention relates to in general, door latches and, in particular, to an infant incubator port assembly.

BACKGROUND ART

Latches on infant incubator ports should posses the following features:

(1) positive closing so that the door cannot be pushed open from the inside with less than a prescribed force, typically fifteen pounds (2) "either/or" operation, so that the door is either obviously open or latched securely closed (3) easy to open with the elbow (4) quiet operation in latching and opening the door Generally, infant incubators in use at the present time have the first three above features but lack the fourth.

The canopy of an infant incubator typically is fabricated from acrylic sheet or similar material which has a hard, reflective surface. Sound which is produced on the surface of the canopy is not attenuated but rather reflected within the canopy. Peak sound levels of 90 dbA and higher have been measured within certain incubators when a door is closed. Such noise can startle and cause discomfort to an infant in the incubator.

DISCLOSURE OF THE INVENTION

A door assembly, constructed in accordance with the present invention, includes a support structure having an opening and a door mounted on the support structure for movement of the door between open and closed positions of the door. Means are provided for urging the door to move to its open position. Also included are latching means between the door and the support structure for closing the door and locking the door in its closed position. The latching means include an impact absorbing member and a latch member engaged by the impacting absorbing member as the two are urged into engagement. The latch member has (i) a contact surface engaged by contact of the impact absorbing member as the door moves to the closed position and (ii) a detent at an end of the contact surface which, when reached by the impact absorbing member as the door moves to the closed position, receives the impact absorbing member to lock the impact absorbing member in the detent and lock the door in its closed position. The latching means also include means for disengaging the impact absorbing member and the latch member to release the impact absorbing member from the detent and permit the door to move to its open position.

Although the invention will be described in connection with an infant incubator, it has potential application where results, comparable to those required in infant incubators, are desired.

BRIEF DESCRIPTION OF THE DRAWINGS

FIG. 1 is a perspective view of a canopy of an infant incubator having door assemblies constructed in accordance with the present invention;

FIG. 2 is a front view, partially in section, of the door hinge portion of a door assembly constructed in accordance with the present invention;

FIG. 3A, 3B, and 3C are bottom views of a door assembly constructed in accordance with the present invention at three different successive positions in the sequence of closing; and FIG. 4 is a sectional view of the latching portion of a door assembly constructed in accordance with the present invention.

BEST MODE OF CARRYING OUT THE INVENTION

FIG. 1 shows an infant incubator canopy 10 having a pair of door assemblies 12 and 14 constructed in accordance with the present invention installed in a front door panel 16 which serves as a support structure for the door assemblies. Door assemblies 12 and 14 each have a door 18 and 20, respectively, which cover openings in panel 16 when the doors are closed. Doors 18 and 20 are mounted on panel 16 for pivotal movement about axes defined by a pair of hinges 22 and 24, respectively.

As shown in FIG. 2, a torsion spring 26 is positioned between hinge 24 and door 20. Spring 26 urges door 20 to pivot in a first direction to the open position of the door. A similar torsion spring is provided between hinge 22 and door 18.

Referring to FIGS. 3A, 3B and 3C, which are bottom views showing door 18 at three successive positions in the sequence of closing, a door assembly, constructed in accordance with the present invention, also includes a latching mechanism between door 18 and support structure 16 for closing the door and locking the door in its closed position. For the embodiment of the invention illustrated, the latching mechanism includes an impact absorbing member in the form of an elastomeric roller 28 mounted on the edge of door 18 opposite from hinge 22. Roller 28 is arranged for rotational movement about an axis parallel to the axis of hinge 22.

The latching mechanism also includes a latch member 30 mounted on panel 16 at the side of the opening in panel 16 opposite from hinge 22. Latch member 30 is mounted for pivotal movement about an axis parallel to the pivot axis of hinge 22 and the rotation axis of roller 28.

Referring also to FIG. 4, latch member 30 has a contact surface **30*a* and a detent 30*b* at the end of contact surface 30*a*. Contact surface 30*a* is an inclined surface which is engaged by rolling contact of roller 28 to pivot the latch member in a first direction, indicated by an arrow 32 in FIG. 3A, to a position such as shown in FIG. 3B, as door 18 pivots against torsion spring 26** toward the closed position of the door.

A spring 34 urges latch member 30 and roller 28 into engagement by pivoting the latch member in a second direction opposite to the direction indicated by arrow 32. Spring 34 extends between the closed end of a bore 36 in latch member 30 and a pin 38 fitted within bore 36 for sliding movement within the bore and bearing against panel 16. As latch member 30 pivots in the direction of arrow 32, spring 34 is compressed. When roller 28 reaches detent **30*b*, so that latch member 30 is free to pivot in the opposite direction, spring 34 is permitted to expand and causes the latch member to pas over roller 28 and lock the roller in detent 30*b*. This in turn locks door 18** in its closed position.

The latching mechanism also includes means for disengaging roller 28 and latch member 30 to release the roller from detent **30*b* and permit door 18 to pivot to its open position. Such means can include a handle 30*c*** formed as a part of latch member 30. As handle 30*c* is pushed toward panel 16, latch member 30 pivots in the direction of arrow 32 shown in FIG. 3A. Such movement of the latch member permits release of roller 28 from detent 30*b* as torsion spring 26 urges door 18 to move to its open position.

In a door assembly constructed in accordance with the present invention, there are four events that generate sound. These four events are:

(1) initial contact of the door against the latch member
(2) increasing engagement of the latch member
(3) the latch member moving into its final position
(4) the door closing against the support structure Elastomeric roller 28 is provided to address the first two events. This roller absorbs energy which would otherwise be converted into sound and it shifts the sound that is produced to a lower frequency to which the human ear is less sensitive.

As door 18 continues to close, roller 28 forces latch member 30 to pivot further and further from its initial position. The increasing engagement of latch member 30 and roller 28, namely event (2), is a rolling contact rather than a sliding contact which produces very low noise with a soft roller.

When latch member 30 moves in an opposite direction to its final, locking position, its motion toward panel 16 is stopped by another elastomeric piece, namely a ring 40, rather than the hard surface of the latch member itself. This reduces the sound produced by event (3).

The sound produced by door 18 closing against panel 16 is minimized by the inclusion of a gasket 42 extending around the opening in panel 16 closed by the door.

With respect to the other features, identified at the outset, a door assembly, constructed in accordance with the present invention, is latched such that the door cannot be pushed open from inside the incubator because the pivot point of latch member 30 is directly below the contact point between door 18 and the latch member when the door is in the closed position. Also, because of the rolling contact between roller 28 and latch member 30, latching is never partial. The spring loaded latch member will either close over roller 28, latching door 18, or torsion spring 26 will pivot the door to its open position. Lastly, handle 30*c* is large enough to be pushed by the user's elbow to open the door.

It should be pointed out that the positions of various parts of the embodiment of the invention illustrated in the drawings can be reversed. For example, instead of mounting roller 28 on door 18 and mounting latch member 30 on support structure 16, the latch member can be carried by the door and the roller can be mounted on the support structure. In addition, instead of mounting latch member 30 for pivotal movement upon engagement by roller 28, the roller can be mounted for pivotal movement.

It also should be noted that the present invention can be applied to doors mounted for sliding, linear movement as they are opened and closed.

The foregoing has set forth exemplary and preferred embodiments of the present invention. It will be understood, however, that various alternatives will occur to those of ordinary skill in the art without departure from the spirit and scope of the present invention.

What is claimed is:

1. A door assembly comprising:

a support structure having an opening;

a door;

means for mounting said door on said support structure for movement of said door between open and closed positions of said door;

means for urging said door to move to said open position of said door;

and latching means between said door and said support structure for closing said door and locking said door in said closed position, said latching means including:

(a) an elastomeric impact absorbing roller mounted for rotational movement about an axis, (b) a latch member mounted for pivotal movement about an axis parallel to said axis of rotation of said roller and having (i) a contact surface engaged by rolling contact of said impact absorbing roller as said door moves to said closed position to move said latch member in a first direction about said axis of movement of said latch member, and (ii) a detent at an end of said contact surface which, when reached by said impact absorbing roller, as said door moves to said closed position, receives said impact absorbing roller to lock said impact absorbing roller in said detent and lock said door in said closed position, (c) means acting on said latch member for urging said latch member to move in a second direction about said axis of movement of said latch member and into engagement with said impact absorbing roller, and (d) means for moving said latch member in said first direction to disengage said impact absorbing roller and said latch member to release said impact absorbing roller from said detent and permit said door to move to said open position.

2. A door assembly according to claim 1 wherein said door is mounted for pivotal movement about an axis parallel to said axis of rotation of said roller and said axis of pivotal movement of said latch member.

3. A door assembly according to claim 2 wherein said roller is mounted on said door opposite from said door mounting means and said latch member is mounted on said support structure at a side of said opening opposite from said door mounting means.

4. A door assembly according to claim 2 wherein said contact surface is inclined to pivot said latch member in said first direction as said door pivots toward said closed position of said door.

5. A door assembly according to claim 4 wherein said means for urging said latch member to move in said second direction includes a spring.

6. A door assembly according to claim 5 wherein said latching means further include an elastomeric stop member attached to said latch member and positioned to engage said support structure upon movement of said latch member toward said support structure.

7. A door assembly according to claim 5 wherein said roller is mounted on said door opposite from said door mounting means and said latch member is mounted on said support structure at a side of said opening opposite from said door mounting means.

8. A door assembly according to claim 7 wherein said latching means further include an elastomeric stop member attached to said latch member and positioned to engage said support structure upon movement of said latch member in said second direction.

9. A door assembly comprising:

a support structure having an opening;

a door;

means for mounting said door on said support structure at a first side of said opening for pivotal movement of said door about a first axis between open and closed positions of said door;

a first spring urging said door to pivot in a first direction to said open position of said door;

an impact absorbing roller mounted on said door opposite from said mounting means for rotational movement of said impact absorbing roller about a second axis parallel to said first axis;

a latch member mounted on said support structure at a second side of said opening opposite from said first side of said opening for pivotal movement of said latch member about a third axis parallel to said first and said second axes, said latch member having (1) a contact surface engaged by rolling contact of said impact absorbing roller to pivot said latch member in a first direction as said door pivots against said first spring in a second direction opposite to said first direction of pivoting of said door toward said closed position of said door, and (2) a detent at an end of said contact surface which, when reached by said impact absorbing roller, permits said latch member to pivot in a second direction opposite to said first direction of pivoting of said latch member;

a second spring urging said latch member to pivot in said second direction of pivoting of said latch member against said impact absorbing roller to latch said impact absorbing roller in said detent in said latch member;

means for pivoting said latch member in said first direction of pivoting of said latch member to disengage said impact absorbing roller and said latch member and release said impact absorbing roller from said detent to permit said door to pivot to said open position;

and an elastomeric stop member attached to said latch member and positioned to engage said support structure upon movement of said latch member in said second direction of pivoting of said latch member.

10. A door assembly according to claim 9 wherein said contact surface is inclined to pivot said latch member in said first direction of pivoting of said latch member.

11. An infant incubator door assembly comprising:

an incubator canopy having an opening;

a door;

means for mounting said door on said incubator canopy for movement of said door between open and closed positions of the door;

means for urging said door to move to said open position of said door;

and latching means between said door and said incubator canopy for closing said door and locking said door in said closed position, said latching means including;

(a) an elastomeric impact absorbing roller mounted for rotational movement about an axis, (b) a latch member mounted for pivotal movement about an axis parallel to said axis of rotation of said roller and having (i) a contact surface engaged by rolling contact of said impact absorbing roller as said door moves to said closed position to move said latch member in a first direction about said axis of movement of said latch member, and (ii) a detent at an end of said contact surface which, when reached by said impact absorbing roller, as said door moves to said closed position, receives said impact absorbing roller to lock said impact absorbing roller in said detent and lock said door in said closed position, (c) means acting on said latch member for urging said latch member to move in a second direction about said axis of movement of said latch member and into engagement with said impact absorbing roller, and (d) means for moving said latch member in said first direction to disengage said impact absorbing roller and said latch member to release said impact absorbing roller from said detent and permit said door to move to said open position.

12. A door assembly according to claim 11 wherein said door is mounted for pivotal movement about an axis parallel to said axis of rotation of said roller and said axis of pivotal movement of said latch member.

13. An infant incubator door assembly comprising:

an incubator canopy having an opening;

a door;

means for mounting said door on said incubator canopy at a first side of said opening for pivotal movement of said door about a first axis between open and closed positions of said door;

a first door spring urging said door to pivot in a first direction to said open position of said door;

an impact absorbing roller mounted on said door opposite from said mounting means for rotational movement of said impact absorbing roller about a second axis parallel to said first axis;

a latch member mounted on said incubator canopy at a second side of said opening opposite from said first side of said opening for pivotal movement of said latch member about a third axis parallel to said first and said second axes, said latch member having (1) a contact surface engaged by rolling contact of said impact absorbing roller to pivot said latch member in a first direction as said door pivots against said first spring in a second direction opposite to said first direction of pivoting of said door toward said closed position of said door, and (2) a detent at an end of said contact surface which, when reached by said impact absorbing roller, permits said latch member to pivot in a second direction opposite to said first direction of pivoting of said latch member;

a second spring urging said latch member to pivot in said second direction of pivoting of said latch member against said impact absorbing roller to latch said impact absorbing roller in said detent in said latch member;

means for pivoting said latch member in said first direction of pivoting of said latch member to disengage said impact absorbing roller and said latch member and release said impact absorbing roller from said detent to permit said door to pivot to said open position;

and an elastomeric stop member attached to said latch member and positioned to engage said incubator canopy upon movement of said latch member in said second direction of pivoting of said latch member.

14. A door assembly according to claim 13 wherein said contact surface is inclined to pivot said latch member in said first direction of pivoting of said latch member.

* * * * *

UNITED STATES PATENT AND TRADEMARK OFFICE

CERTIFICATE OF CORRECTION

PATENT NO. : 5,112,293

DATED : May 12, 1992

INVENTOR(S) : Robert K. Vaccaro

It is certified that error appears in the above—identified patent and that said Letters Patent is hereby corrected as shown below:

Col. 2, line 62 - Change "pas" to --pass--.

Col. 4, line 52 - Change "includes" to --include--.

Col. 6, line 27 - Delete "door" (first occurrence).

Signed and Sealed this

Seventeenth Day of August, 1993

Bruce Lehman

*Attest:*

BRUCE LEHMAN

*Attesting Officer*

*Commissioner of Patents and Trademarks*